US007147590B2

(12) United States Patent
Toven

(10) Patent No.: US 7,147,590 B2
(45) Date of Patent: Dec. 12, 2006

(54) RUNNER'S TRAINING AID

(76) Inventor: John V. Toven, 7700 Topanga Canyon Blvd., #307, Canoga Park, CA (US) 91304

( * ) Notice: Subject to any disclaimer, the term of this patent is extended or adjusted under 35 U.S.C. 154(b) by 0 days.

(21) Appl. No.: 10/976,435

(22) Filed: Oct. 29, 2004

(65) Prior Publication Data

US 2005/0107222 A1 May 19, 2005

Related U.S. Application Data

(60) Provisional application No. 60/516,325, filed on Oct. 31, 2003.

(51) Int. Cl.
*A63B 21/00* (2006.01)

(52) U.S. Cl. ..... 482/51; 482/121; 482/124

(58) Field of Classification Search ..... 482/105, 482/124, 74, 121, 907; 601/23; 2/68, 69
See application file for complete search history.

(56) References Cited

U.S. PATENT DOCUMENTS 1,402,179 A * 1/1922 Piscitelli ..... 482/124
1,432,013 A * 10/1922 Blake ..... 482/124
2,035,010 A * 3/1936 Rawlings ..... 601/23
4,180,261 A 12/1979 Kolka
4,337,938 A 7/1982 Rodriguez
4,527,794 A 7/1985 Dunn
4,993,705 A 2/1991 Tölle
5,167,598 A 12/1992 Sands ..... 482/74
5,176,597 A 1/1993 Bryne ..... 482/74
5,217,186 A 6/1993 Stewart. ..... 244/142
5,441,255 A 8/1995 Verbick ..... 273/26
5,529,556 A 6/1996 Segarra ..... 482/74
5,993,362 A * 11/1999 Ghobadi ..... 482/124
6,012,993 A 1/2000 Guerriero ..... 473/424
6,428,495 B1 * 8/2002 Lynott ..... 602/23
6,436,014 B1 8/2002 Cirjak ..... 482/105
6,482,128 B1 11/2002 Michalow ..... 482/14
6,551,221 B1 4/2003 Marco ..... 482/74

* cited by examiner

*Primary Examiner*—Jerome Donnelly
(74) *Attorney, Agent, or Firm*—Fulwider Patton LLP

(57) ABSTRACT

An apparatus for training a runner a proper arm-swing technique includes a body harness, and first and second engagement members for engaging the wrists or hands of the user. In one embodiment, the engagement members are grips that the user grasps while running. The apparatus further includes first and second upper straps configured to attach to the body harness and to the wrist coverings. The apparatus also includes first and second lower straps configured to attach to the body harness and to the wrist coverings. The body harness may be configured as a vest or formed from a plurality of straps. The arm-swing apparatus may further include first and second back springs configured to attach to the body harness and to a belt configured to fit around the waist of the runner. A method of using the arm-swing training apparatus is also disclosed.

15 Claims, 5 Drawing Sheets

RUNNER'S TRAINING AID

CROSS-REFERENCE TO RELATED APPLICATION

This application claims priority from U.S. Provisional Patent Application Ser. No. 60/516,325, filed Oct. 31, 2003 and entitled, "Runner's Training Aid," which is incorporated by reference in its entirety.

FIELD OF THE INVENTION

The invention relates to training aids for athletics and, in particular, to a training aid to assist in developing proper technique for running or jogging.

GENERAL BACKGROUND AND STATE OF THE ART

Proper right-angle arm swinging during running so as to save energy and reduce drag is a technique that can be difficult to teach to runners and others. Training devices may serve to facilitate a runner's use of right-angle arm swinging. Such devices may promote the development of muscle memory on the part of runners and other athletes, such that practicing with such a training aid causes the users to reflexively hold their arms at ninety (90) degree angles, forearm to biceps, while they are continuously swinging their arms during running. However, most of the current products marketed to improve running performance address muscle strengthening using resistance devices that are extremely inadequate to improve running speed and endurance if the user is not provided proper technique and form training.

A known runner's aid includes a flat bottom surface, a flat posterior surface and two flat pentagonal lateral surfaces. The surfaces are all jointed together to form one hollow unit. The flat pentagonal lateral surfaces are formed with a pair of parallel horizontal aperture slits and a pair of parallel vertical aperture slits through which banding is threaded. The device is secured to the runner to hold the runner's arm fast in such a manner that the upper arm and forearm of said runner's arm forms a right angle. One device is used on the runner's right arm. A second device is used on a runner's left arm. Such devices apparently attempt to maintain the arms at a ninety-degree angle such that the device acts like a cast to achieve muscle memory. However, such devices have the disadvantage that they lock the forearms to the biceps so as to unduly limit the free range of motion of the arms. Such devices may have difficulty achieving proper and realistic muscle memory.

It is also known that a jogger or runner's aid may increase the endurance of a runner by supporting the weight of his arms as he runs. Such a known device includes a shoulder strap that fits around the back of the user's neck. A pair of end straps is pivotally secured to the ends of the shoulder strap by rings, and includes hand loops and thumb loops at their ends for supporting the wearer's arms. The length of the straps may be adjustable to accommodate different people. An optional pedometer or other type of distance measuring device may be secured to one of the end straps. However, such a device has no apparent benefits for and indeed may be detrimental to training proper arm-swing form and technique.

It is further known to use an athletic device for training the muscles of the upper body, in particular the arm muscles, in the course of running and walking. Such a device includes a vest to be worn by a user, an elastically expandable strap removably fastened in place across a back part of the vest and having at its ends two cuffs for connection to the arms of the user. That athletic device acts on the involuntarily swinging arms during running and walking, creating a constant counter-force that must be overcome by the arms so that the muscles of the arms and upper body are strengthened. Such strengthening devices add little or nothing to or even detract from training the runner's arm-swinging technique.

The following patents are related to training devices for athletes, and the contents of each of the following patents are hereby incorporated herein by reference: 4,337,938; 5,167,598; 4,993,705; 6,202,263; 5,529,556; 6,551,221; 5,441,255; 4,527,794; 4,180,261; 5,176,587; 6,012,993.

Accordingly, there is a need for a simple, cost-effective, yet efficient athletic device that provides an uncomplicated method of improving upper body walking and running mechanics for all ages and levels of recreation and sports.

SUMMARY OF THE INVENTION

The present invention is directed to a device that includes a body harness (for example, a vest) with connected straps and stretch cords that guide the arms, shoulders and/or back of a user, such as a runner or other athlete, to improve upper body walking and running technique for users of all ages and for various levels of recreation and sports. One purpose for the development of the runner's training aid (arm-swing trainer) of the present invention is to provide a simple, uncomplicated method of improving upper body walking and running mechanics. The present runner's aid helps teach the most common skills in walking and running mechanics that are often the most difficult to learn and repeat.

One embodiment of the present invention includes a vest or partial vest that acts as a harness with four connecting straps, and may further include two stretch cords. Each of the straps is connected to a wrist guard or similar covering for each hand, or to handles that the user may grip. A first upper strap extends from the left hand to the left shoulder portion of the body harness, and a second lower strap extends from the left hand to the left side of the body harness proximate the left side of the user's lower back. A set of third and fourth straps is similarly connected to the right hand, right shoulder and right back. These straps help maintain the arms angled at an approximately ninety degree position through the act of walking or running by limiting the range of motion the arms are allowed to travel. The optional two stretch cords are connected from each shoulder so as to cross the back and connect at opposite sides of the lower back to a belt or similar mechanism. The stretch cords pull the shoulders back and in, allowing for better posture and better center of gravity for balance while the user is walking or running.

In another embodiment, an apparatus for training includes a harness, left and right grips, a first pair of straps extending from said harness and interconnecting with the left grip, and a second pair of straps extending from said harness and interconnecting with the right grip. The length of each of the straps may be adjustable. In one embodiment, the length of the straps is adjustable so as to guide a users arms to swing back and forth while running at an angle of approximately 90 degrees. The grips may be made of a relatively rigid material, a relatively flexible material, and/or a relatively rigid core and a relatively flexible covering. The apparatus may also include a belt, a first back spring having a first end configured to attach to the body harness and a second end configured to attach to the belt, and a second back spring having a first end configured to attach to the body harness and a second end configured to attach to the belt. The harness is typically configured as a vest, although other configurations are possible.

Another embodiment of the invention is a method for training in proper running form. The method includes possessing an embodiment of the training apparatus, securing the body harness of the apparatus onto the torso of a user, securing the first engagement member to at least one of a right wrist and a right hand of a user, securing the second engagement member to at least one of a left wrist and a left hand of a user, adjusting the length of the first upper strap so that the left wrist does not traverse substantially below the waist of the user, adjusting the length of the first lower strap so that the left wrist remains substantially proximate the waist of the user, adjusting the length of the second upper strap so that the right wrist does not traverse substantially below the waist of the user, and adjusting the length of the second lower strap so that the right wrist remains substantially proximate the waist of the user. The method may also include other steps, as described below and in the claims.

Other features and advantages of the present invention will become apparent from the following detailed description, taken in conjunction with the accompanying drawings, which illustrate, by way of example, the principles of the invention. The invention is not limited by this Summary, but is further defined with reference to the Brief Description of the Drawings, the Specification, and claims.

DETAILED DESCRIPTION OF THE PREFERRED EMBODIMENTS

Generally speaking, the present invention relates to athletic devices that facilitate training muscle memory in the arms and upper body of the user. An arm-swing trainer is configured to improve upper body walking and running technique. In one embodiment, the arm-swing trainer includes a body harness with connected straps and stretch cords that guide and constrain the arms, shoulders and back. One such trainer promotes proper right-angled arm swinging and reducing arm waving during running or walking. This allows the user to train his or her muscles so as to walk and run with a healthier and more efficient technique.

Figure 1:
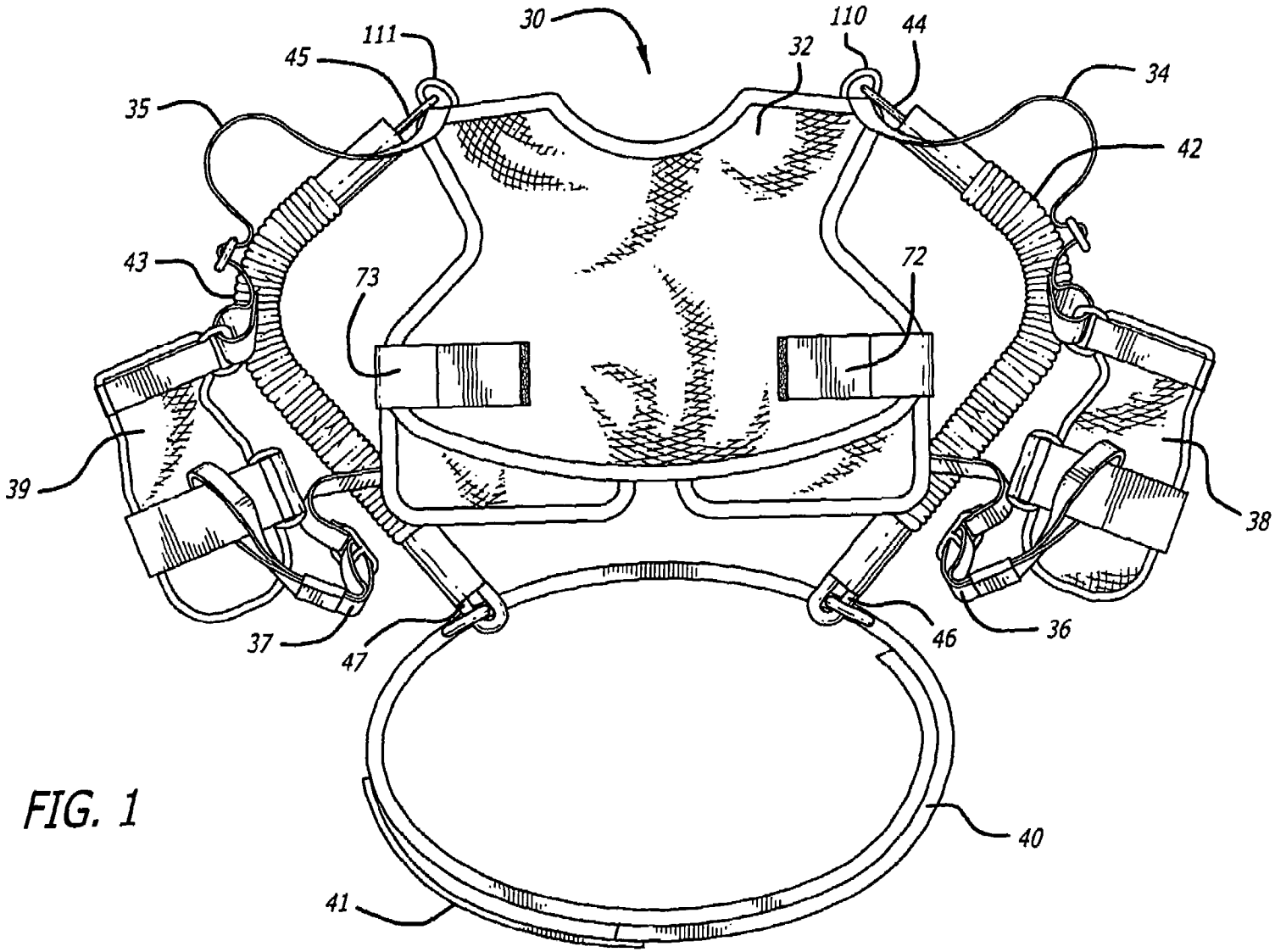
FIG. 1 is a front plan view of the runner's training aid of the present invention.
Figure 2:
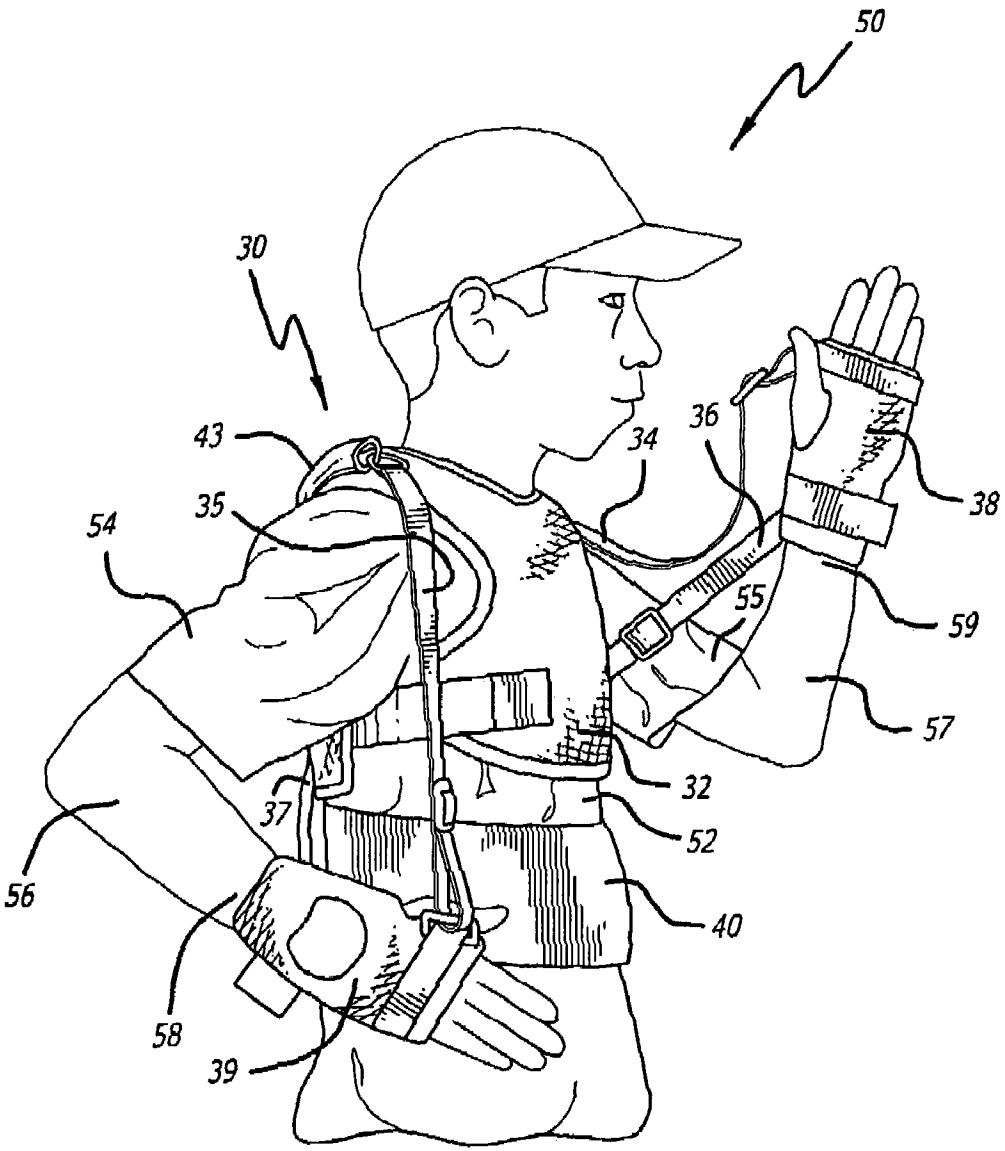
FIG. 2 is a side schematic view of the runner's training aid of the present invention during use.
Figure 3:
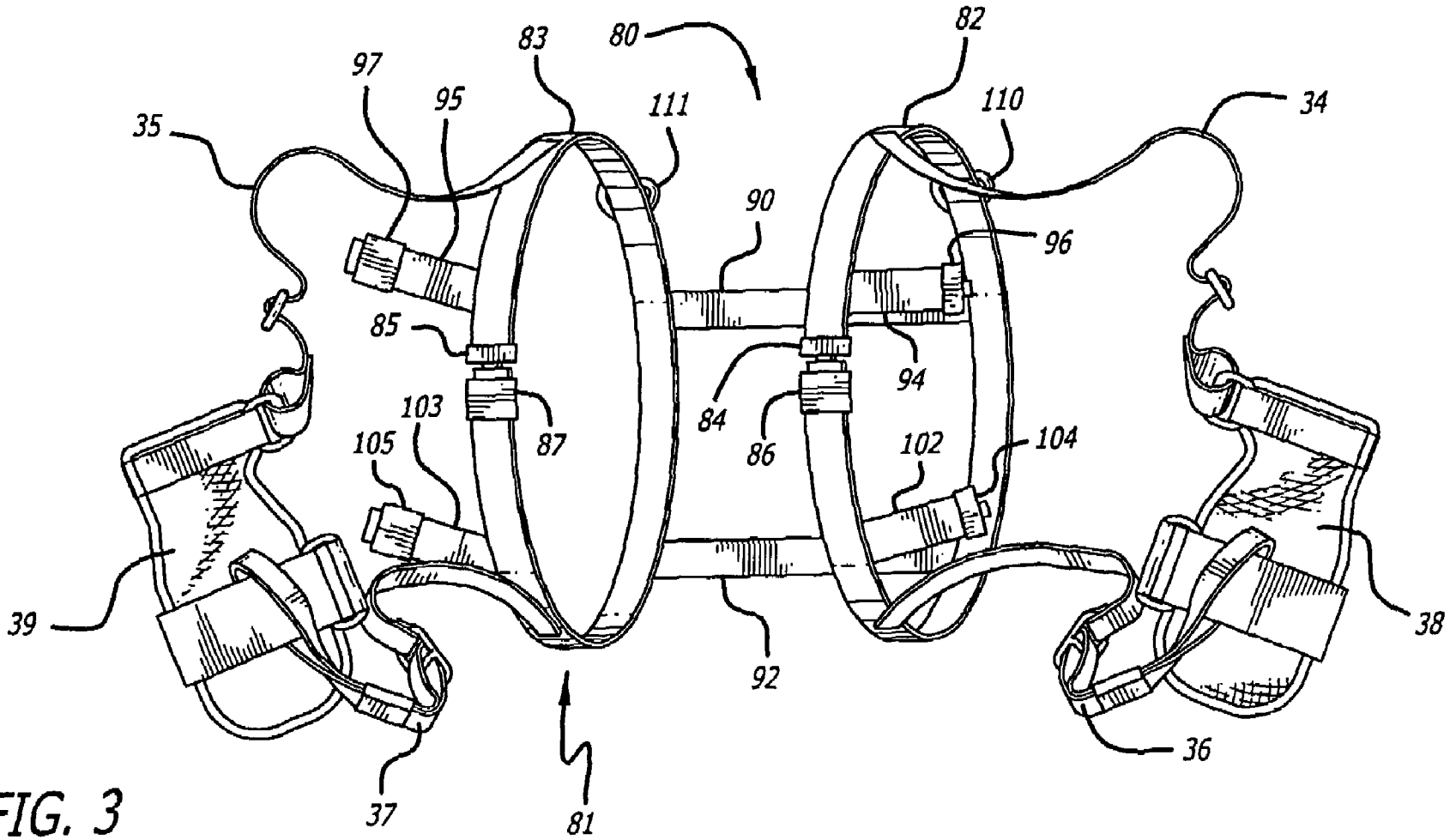
FIG. 3 is a front plan view of an alternative embodiment of the runner's aid of the present invention, wherein the body harness is made from a plurality of straps.

Referring now to the drawings for purposes of illustration and particularly to FIGS. 1 and 2, the runner's training aid (arm-swing trainer) 30 of the present invention for use by a runner 50 includes a body harness 32 that is configured to fit on and/or over the runner's torso 52. As shown in FIG. 1, the body harness may be configured in a vest-like manner covering most of the runner's torso, similar to a body protector worn by hockey players or a chest protector worn by baseball catchers. Alternatively, the body harness 81 may be configured from a plurality of interlocking straps, as shown in FIG. 3.

The body harness is configured with a several straps or other restraint devices to limit or constrain the movement of the runner's upper arm 54, 55 and lower arm 56, 57 to maintain the arms in close proximity to the runner's torso and to keep the upper and lower arms at right angles to each other. As shown in FIGS. 1 and 2, an upper left strap 34 has a first end connected to the upper portion of the body harness 32, and has a second end for securing to the runner's lower left arm 57 or wrist 59. Similarly, an upper right strap 35 has a first end connected to the upper right portion of the body harness, and has a second end for securing to the runner's lower right arm 56 or wrist 58. The purpose of the upper straps is to limit the downward mobility of the runner's forearm.

A lower left strap 36 has a first end removably or fixedly connected to the lower portion of the body harness, and has a second end for removably or fixedly securing to the runner's lower left arm 57 or wrist 59. Similarly, a lower right strap 37 is removably or fixedly connected to the lower portion of the body harness, and is removably or fixedly secured to the runner's lower right arm 56 or wrist 58. The upper and lower straps may be removably or fixedly connected to the front sides or back of the body harness as appropriate for the particular configuration of the body harness and application to particular individuals. The upper straps 34, 35 and lower straps 36, 37 may be connected to the runner's forearms or wrists. The restricting straps may be connected directly to the runner's wrists or lower arms by various mechanisms, such as buckles, cinches and hook-and-loop fasteners (VELCRO). Alternatively, the restrictive left straps may be connected to a left wrist covering 38, and the restrictive right straps connected to a right wrist covering 39. Such wrist coverings may be in the form of a glove, mitten, roller/ice skating wrist guard, or similar suitable device. The wrist coverings may include straps with buckles and/or hook-and-loop fasteners to facilitate securing the covering and removing the covering from the wrists of the runner.

As shown in FIG. 2, the upper straps 34, 35 of the arm-swing trainer 30 are configured to limit the downward movement of the wrist coverings 38, 39 and the lower arm 56, 57 of the runner. The length of the upper straps is preferably configured so that the runner's wrists 58, 59 do not travel below the runner's waist as the arms are swinging while the runner moves forward. In addition, the lower straps 36, 37 are configured to limit the outward movement of the runner's lower arm and wrists. These straps may be configured with a buckle, cinch or other mechanism to allow adjustment of the length of the strap so as to configure the arm-swing trainer to a particular runner. Likewise, the body harness 32 may contain adjustable straps 72, 73 or other positioning devices, such as hook-and-loop fasteners, to adapt the body harness to the runner's torso 52. Thus, the arm-swing trainer of the present invention may be configured for runners of all sizes, shapes and ages.

Referring now to FIG. 3, an alternative embodiment of the arm-swing trainer 80 includes a body harness 81 configured from a plurality of straps and fastening mechanisms. Various suitable configurations of such a body harness are contemplated by the present invention, and the embodiment herein is by way of example only. The body harness includes a first vertical body strap 82 configured to be positioned over the user's left shoulder. Similarly, the body harness includes a second vertical body strap 83 configured to be positioned over the user's right shoulder.

The vertical straps 82, 83 may be formed to loop over each shoulder and/or cross in the front and/or back torso of the user. The vertical straps may include a fastening mechanism such as male fittings 84, 85 and female fittings 86, 87 that secure open ends of the strap. Such fastening mechanisms may also include buckles, snaps, grommets, hook-and-loop fasteners and other suitable devices. Alternatively, the vertical body straps may be formed in a closed loop without need for fastening mechanisms. The left vertical body strap and the right vertical body strap may be connected by one or more cross straps 90, 92 across the back of the user. For example, an upper back cross strap may be located proximate over the shoulder blades, and a lower back cross strap may be configured to be positioned in the lumbar area of the user.

Referring again to FIG. 3, the body harness 81 may further include a series of cross straps to secure the vertical body straps 82, 83 across the front torso of the user. For example, an upper front cross strap may include a left portion 94 and a right portion 95 that are secured by fastening devices, such as a buckle having male 96 and female 97 fittings. Again, various fastening mechanisms may be used to join the cross strap. In addition, a lower front cross strap may be provided having a left portion 102 and a right portion 103 that are secured by a fastening mechanism, such as a male buckle fitting 104 and a female buckle fitting 105. The upper restraining straps 34, 35 and lower restraining straps 36, 37 may be fixedly or removably secured to the vertical straps 82, 83. As heretofore described, the restraining straps are appropriately secured to the wrist coverings 38, 39. In addition, O-rings, D-rings, or other fastening mechanisms 110, 111 may be attached to the vertical straps so as to secure back springs 42, 43 (not shown). The body harness configured from straps (as shown in FIG. 3) performs essentially the same functions as the body harness configured as a vest (as shown in FIG. 1).

The arm-swing trainer 30 of the present invention may further include a mechanism for correcting the general posture of the runner. Referring again to FIGS. 1 and 2, the arm-swing trainer may further include a belt 40 for positioning around the runner's torso 52 proximate the runner's waist. The belt may further include a fastener 41, such as a buckle or hook-and-loop mechanism, to accommodate various sizes and shapes of the runner's torso and waist. The belt is connected to the body harness 32 by a left back spring 42 and a right back spring 43. The left back spring may be connected to the upper left portion of the body harness by an upper fastener 44 and connected to the lower left portion of the belt by a left back spring lower fastener 46. Similarly, the right back spring may be connected to the upper right portion of the body harness by a right back spring upper fastener 45 and connected to the lower right portion of the belt by a right back spring lower fastener 47. The belt and back springs may be used with the body harness with the restraining straps 34, 35, 36, 37 detached from or connected to the body harness 32.

The back spring mechanisms 42, 43 and associated fasteners 44, 45, 46, 47 may be configured from materials well known to those of skill in the art. The back springs may be fixedly or removably attached to the body harness by clips, hook-and-loop fasteners, rings, buckles or similar devices. The back spring may include an elastic member or similar force applying device, such as a bungee cord, so as to draw the shoulders and head backwards and downwards to provide appropriate running posture. The length of elastic members may be adjusted using rings, clips, buckles or other suitable devices. One example of such back springs and associated fasteners has been disclosed in U.S. Pat. No. 6,202,263, the contents of which are hereby incorporated herein by reference.

Use of the arm-swing trainer 30, 80 includes attaching the body harness 32, 81 to the torso 52 of the runner 50. Adjustable straps or other fasteners removably secure the body harness to the torso. The left wrist covering 38 is then removably secured over the runner's left wrist 59. The upper left strap 34 is then adjusted so that the runner's lower left arm 57 is restrained from traversing significantly below the runner's waist and prevents the wrist from moving significantly behind the runner's back. The lower left strap 36 is then adjusted so that the runner's lower left arm and upper left arm 55 remain close to or proximate the runner's torso. The right wrist covering 39 of the arm-swing trainer is then removably secured to the runner's right wrist 58. The upper right strap 35 and lower right strap 37 are then adjusted in conformance with the physical characteristics of the runner as heretofore described regarding the left straps. The sequence of attaching the wrist coverings, left or right, and upper and lower straps, left or right, may be performed in any convenient or efficient manner and order so as to achieve the proper restraints on the runner's arms. Likewise, the straps may be adjusted before or after the body harness and wrist coverings are positioned on the user. It is contemplated that periodic adjustments to the various straps may be made to exaggerate or emphasize a particular feature of the runner's body motions that require correction.

When the runner requires posture adjustment, the belt 40 of the arm-swing trainer 30 may be attached to the runner's torso 52 proximate the waist. The left back spring 42 is attached to the upper portion of the body harness 32, and the lower portion of the back spring is connected to the belt. Likewise, the right back spring 43 is similarly attached to the body harness and belt. The back springs may be crossed in the back, such that one back spring connects the upper left shoulder to the right side of the waist and the other back spring connects the right shoulder to the left side of the waist. The belt and back springs may be attached to the body harness prior to positioning on the runner. Further, the arm-swing trainer may be configured with the body harness and belt as a single unit that does not permit detachment of the belt from the harness, but allows for adjustment of the length of the back spring so as to conform to various body shapes of various runners.

Figure 4:
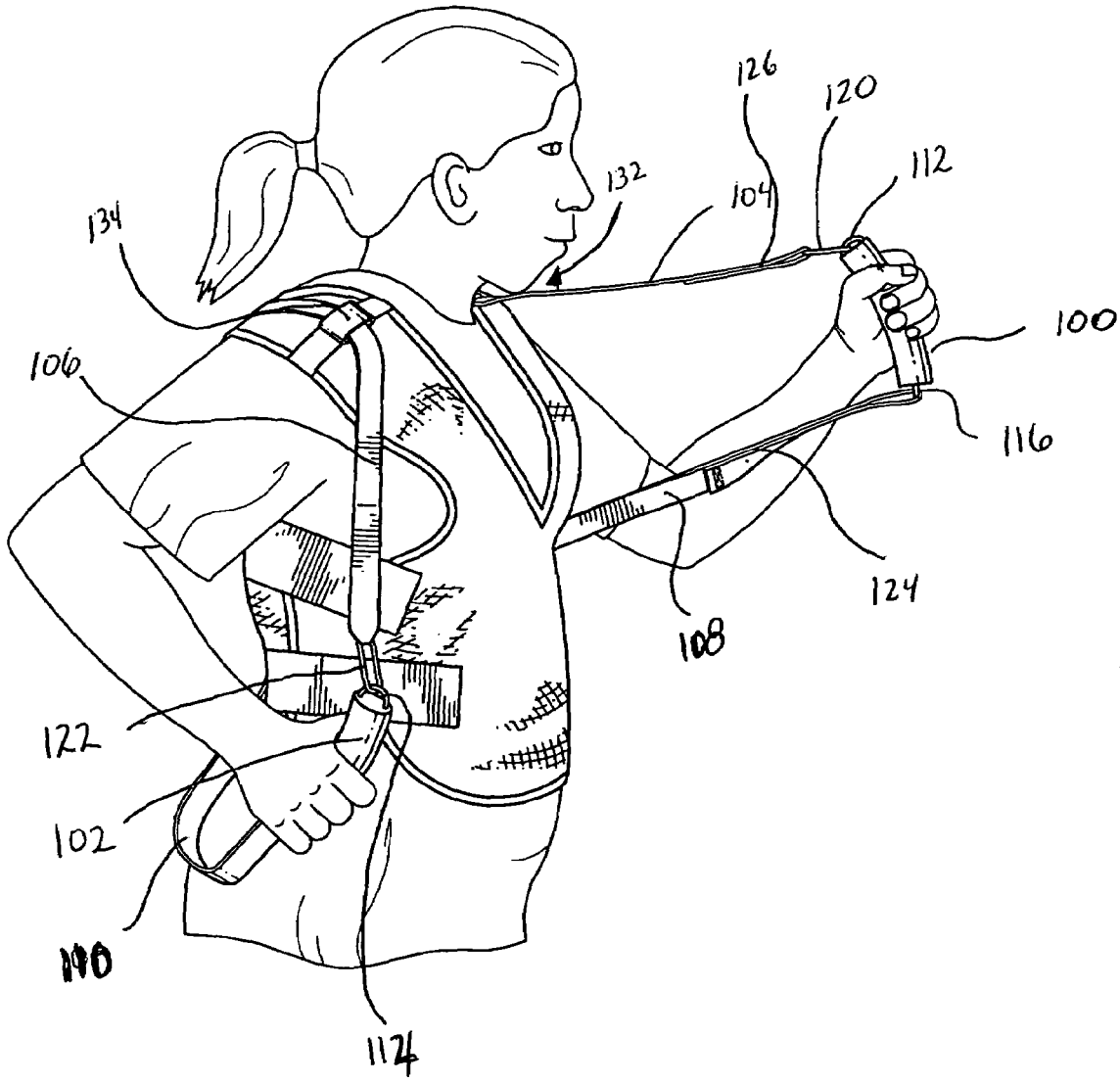
FIG. 4 illustrates a runner wearing another embodiment of the invention.
Figure 5:
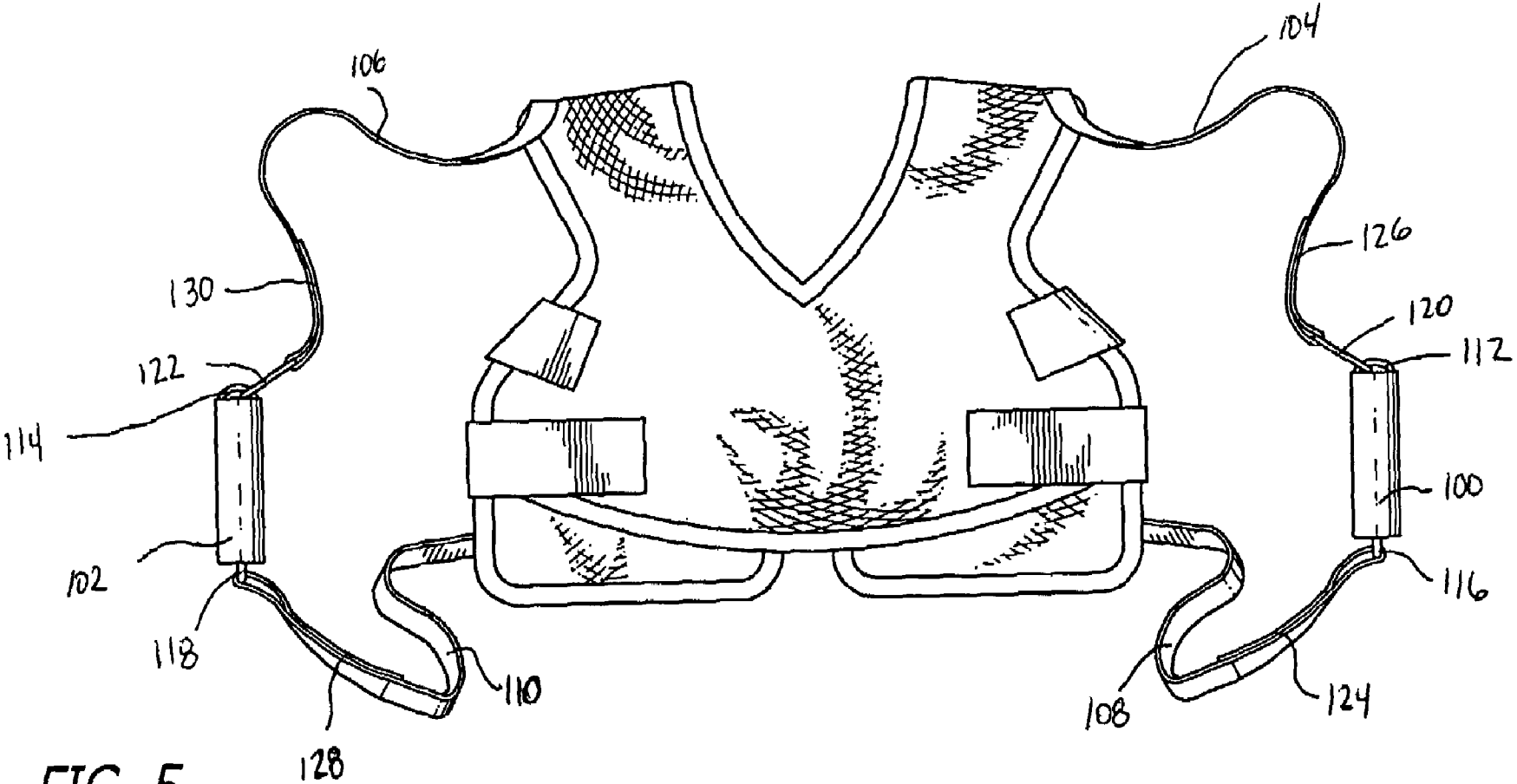
FIG. 5 is a front view of the embodiment of FIG. 4.

FIGS. 4 and 5 illustrate a further alternative embodiment of the invention, in which handles 100, 102 are provided for the runner to grip as he or she runs. The handles may alternatively be termed "engagement members," which the hand engages. In the previously-discussed embodiment, engagement members were provided to engage with the wrist. The handles of FIGS. 4 and 5 are each attached to associated upper 104, 106 and lower 108, 110 strap portions. As best seen in FIG. 5, the handles may include upper 112, 114 and lower 116, 118 rings, as well as an optional upper and/or lower extension ring 120, 122. In the embodiment of FIG. 4, the extension ring pivots freely with respect to the associated upper ring.

The upper strap portions 104, 106 extend through the respective upper extension rings 120, 122 in order to secure the upper strap portions to the respective handles. The lower strap portions loop through the lower rings. Both upper and lower strap portions may be provided with hook-and-loop material in areas 124, 126 and 128, 130, to allow the length of the straps to be adjusted. By adjusting the upper and lower strap portions, the user may ensure that the straps are of a proper length so as to allow proper running form as previously described. Alternatively, the strap sections in areas 124, 126 and 128, 130 may be sewn together, and adjustment of strap length done by way of buckles, hook and loop material, or other adjustment means known in the art on the back of the vest.

The upper strap portions 104, 106 extend through sleeves 132, 134 on each side of the should of the vest, that are sewn or otherwise attached to the shoulder portion of the vest. The strap is then sewn or otherwise secured to the back of the vest. As a further alternative, the straps may be adjustably affixed to the vest itself, as with hook-and-loop material, a buckle, or other known scheme for adjustably mounting a strap to a vest. It is noted that the upper and lower strap portions may be portions of a single strap that is affixed to the vest, or may be separate strap members that are affixed to the vest.

The handles 100, 102 may be made out of any material suitable for exercise, such as a plastic or rubber. Preferably the handles are flexible and provide cushioning to the hand when gripped by the user. However, in other embodiments, the handles may be more rigid, and may even be made of materials such as wood, hard rubber or molded plastic, with or without an external flexible or cushioned covering. If a covering is used, the covering may be molded, such that specific patterns or contours are molded into the covering.

While several particular forms of the invention have been illustrated and described, it will be apparent that various modifications can be made without departing from the spirit and scope of the invention. For example, the straps may be replaced with cords and, in some embodiments, cords would be equivalents to straps. The straps may also be made adjustable by any of a variety of methods known in the art, including buckles, loops, hook-and-loop material, and the like. The vest itself may be made from any of a variety of materials known in the art, ranging from fabric-based materials to any other material from which vests may be made.

References to materials of construction and specific dimensions are not intended to be limiting in any manner and other materials and dimensions could be substituted and remain within the spirit and scope of the invention. Accordingly, it is not to be intended that the invention be limited, except as by the appended claims.

I claim:

1. An apparatus, comprising:

a body harness;

a first engagement member to engage with at least one of a hand and a wrist;

a second engagement member to engage with at least one of a hand and a wrist;

a first upper strap having a first end configured to attach to the body harness and a second end configured to attach to the first engagement member;

a second upper strap having a first end configured to attach to the body harness and a second end configured to attach to the second engagement member;

a first lower strap having a first end configured to attach to the body harness and a second end configured to attach to the first engagement member; and a second lower strap having a first end configured to attach to the body harness and a second end configured to attach to the second engagement member;

a belt;

a first back spring having a first end configured to attach to the body harness and a second end configured to attach to the belt; and a second back spring having a first end configured to attach to the body harness and a second end configured to attach to the belt.

2. The apparatus of claim 1, wherein the body harness is configured as a vest.

3. The apparatus of claim 1, wherein the body harness is formed from a plurality of straps.

4. The apparatus of claim 1, wherein the engagement members are handles that are gripable by a human hand.

5. The apparatus of claim 1, wherein the handles are flexible.

6. The apparatus of claim 1, wherein the handles each have an upper strap attachment member and a lower strap attachment member.

7. The apparatus of claim 1, wherein the straps each have a length, the length of at least one of said straps being adjustable.

8. The apparatus of claim 1, wherein the straps each have a length, the length of all of said straps being adjustable.

9. The apparatus of claim 1, wherein at least one of said straps includes hook-and-loop material for adjusting the length of the strap.

10. The apparatus of claim 1, wherein the straps are adjustable at the back of the body harness.

11. A method for training in proper running form, comprising:

providing an apparatus including, (a) a body harness, (b) a first engagement member to engage with at least one of a hand and a wrist, (c) a second engagement member to engage with at least one of a hand and a wrist, (d) a first upper strap having a first end configured to attach to the body harness and a second end configured to attach to the first engagement member, (e) a second upper strap having a first end configured to attach to the body harness and a second end configured to attach to the second engagement member, (f) a first lower strap having a first end configured to attach to the body harness and a second end configured to attach to the first engagement member, and (g) a second lower strap having a first end configured to attach to the body harness and a second end configured to attach to the second engagement member;

securing the body harness of the apparatus onto the torso of a user;

securing the first engagement member to at least one of a right wrist and a right hand of a user;

securing the second engagement member to at least one of a left wrist and a left hand of a user;

adjusting the length of the first upper strap so that the left wrist does not traverse substantially below the waist of the user;

adjusting the length of the first lower strap so that the left wrist remains substantially proximate the waist of the user;

adjusting the length of the second upper strap so that the right wrist does not traverse substantially below the waist of the user; and adjusting the length of the second lower strap so that the right wrist remains substantially proximate the waist of the user.

12. The method of claim 11, further comprising:

providing a belt, a first back spring having a first end configured to attach to the body harness and a second end configured to attach to the belt, and a second back spring having a first end configured to attach to the body harness and a second end configured to attach to the belt;

securing the first back spring to the body harness;

securing the first back spring to the belt;

adjusting the length of the first back spring;

securing the second back spring to the body harness;

securing the second back spring to the belt; and adjusting the length of the second back spring.

13. The apparatus of claim 4, wherein the handles include a relatively rigid core and a relatively flexible covering.

14. The apparatus of claim 1, wherein the engagement members are handles that are gripable by a human hand.

15. The apparatus of claim 14, wherein the handles include a relatively rigid core and a relatively flexible cover.

* * * * *